US010293408B2

(12) United States Patent
Ishikawa et al.

(10) Patent No.: US 10,293,408 B2
(45) Date of Patent: May 21, 2019

(54) METHOD AND DEVICE FOR PRODUCING SHOTS

(71) Applicant: SINTOKOGIO, LTD., Nagaoya-shi, Aichi (JP)

(72) Inventors: Masayuki Ishikawa, Toyokawa (JP); Naoya Tanuma, Toyokawa (JP); Tomohiro Togari, Toyokawa (JP)

(73) Assignee: SINTOKOGIO, LTD., Aichi (JP)

( * ) Notice: Subject to any disclaimer, the term of this patent is extended or adjusted under 35 U.S.C. 154(b) by 503 days.

(21) Appl. No.: 14/779,492

(22) PCT Filed: Dec. 11, 2013

(86) PCT No.: PCT/JP2013/083221
§ 371 (c)(1),
(2) Date: Sep. 23, 2015

(87) PCT Pub. No.: WO2014/155852
PCT Pub. Date: Oct. 2, 2014

(65) Prior Publication Data

US 2016/0031014 A1 Feb. 4, 2016

(30) Foreign Application Priority Data

Mar. 27, 2013 (JP) ..... 2013-066298

(51) Int. Cl.
*B22F 9/10* (2006.01)

(52) U.S. Cl.
CPC ..... *B22F 9/10* (2013.01)

(58) Field of Classification Search
None
See application file for complete search history.

(56) References Cited

U.S. PATENT DOCUMENTS 2,310,590 A 2/1943 Marette
4,339,401 A * 7/1982 Clark ..... B22F 9/082 264/11

(Continued)

FOREIGN PATENT DOCUMENTS

CN 2541089 3/2003
CN 102112216 A 6/2011

(Continued)

OTHER PUBLICATIONS

Machine Translation of JP 51-64456 (published Jun. 3, 1976) from J=Plat Pat.*

(Continued)

*Primary Examiner* — George Wyszomierski
(74) *Attorney, Agent, or Firm* — Finnegan, Henderson, Farabow, Garrett & Dunner, LLP

(57) ABSTRACT

A method and device for producing shots are provided where the yield is improved. In a space (5) for forming molten drops, which space is surrounded by water (1) in a tank (20), by a cover (3) to cover an area surrounding a disc (2) that is located above the water and rotates, and by a tundish (4) that penetrates through the cover, a gas is discharged though an opening (6) that is formed in the cover and the film (9) of the water is formed on the inner surface of the cover. The molten metal (10) flows through the hole (11) in the bottom of the tundish to be supplied onto the rotating disc. The molten drops are formed by centrifugal force from the molten metal that has been supplied to the disc. Then the molten drops are caused to collide with the film of the water on the inner surface of the cover, to be divided into the droplets that are smaller than the molten drops. The droplets are cooled and solidified.

14 Claims, 3 Drawing Sheets

(56) References Cited

U.S. PATENT DOCUMENTS

| | | | | |
|---|---|---|---|---|
| 5,738,705 | A * | 4/1998 | Anderson | B22F 9/08 75/332 |
| 2009/0263728 | A1 * | 10/2009 | Zuraw | B22F 9/10 429/344 |

FOREIGN PATENT DOCUMENTS

| | | |
|---|---|---|
| JP | 14-006517 | 5/1939 |
| JP | 51-64456 | 6/1976 |
| JP | 54-38259 | 3/1979 |
| JP | S 60-190503 | 9/1985 |
| JP | S61-231108 | 10/1986 |
| JP | 6-340905 | 12/1994 |
| JP | 8-277403 | 10/1996 |
| JP | H10-317019 | 12/1998 |
| JP | 2002-241809 | 8/2002 |

OTHER PUBLICATIONS

Office Action for CN Application No. 201380075015.8 dated Jun. 29, 2016, (2 pages).

English-language International Search Report from the Japanese Patent Office for International Application No. PCT/IB2013/083221, dated Feb. 25, 2014.

* cited by examiner

METHOD AND DEVICE FOR PRODUCING SHOTS

TECHNICAL FIELD

The present invention relates to a method and a device for producing shots. Specifically, it relates to a method and a device for producing shots that are made of iron based alloy, such as cast steel or stainless steel, to be used in various types of shot-blasting machines and shot-peening machines. More specifically, it relates to a method and a device for producing shots by using centrifugal force so that the yield of the shots is improved.

BACKGROUND ART

As methods for producing common metallic powder, various methods, such as water atomization, gas atomization, a rotating electrode process, and a molten-metal dropping process, have been known. Reduced iron powder and atomized iron powder are versatile as iron powder for powder metallurgy. Water atomization is predominant in the methods for producing atomized iron powder. Iron powder produced by water atomization generally has a particle size of 0.2 mm or less. The iron powder has an irregular shape. Iron powder that is generally spherical is produced by gas atomization. However, the cost for producing powder by that process increases, since a large amount of inert gas is consumed. This is a problem. Shots should have a particle size (a mean particle size) of 0.03 to 4 mm. Thus the range of the particle sizes is wide. Further, the shots should be generally spherical. Thus as a method for producing the shots, the method is required to produce particles of various particle sizes and to produce spherical particles. Under these circumstances, a general method for producing metallic powder with no change cannot be used for producing the shots.

A conventional and well-known method for producing the shots is called a centrifugal method. By that method, a disc and a unit for rotating the disc are provided at the center of a large tank for water. A narrow flow of molten metal is dropped onto the disc by means of a tundish or the like. Molten drops are formed from the molten metal by centrifugal force. The distribution of the particle sizes of the shots made by the centrifugal method can be controlled to some extent by changing the speed of the rotation of the disc (i.e., the speed at the rim of the disc, at which speed the molten drops are ejected). However, that method has a low yield (see U.S. Pat. No. 2,310,590 and Chinese Utility Model No. 2,541,089). This is a problem.

U.S. Pat. No. 2,310,590 relates to a conventional centrifugal method for producing shots made of cast iron. It discloses a method for causing molten drops to be fine by spraying pressurized water onto the flying molten drops in a publicly-known centrifugal method, wherein a disc and a unit for rotating the disc are provided at the center of a large tank for water, wherein a narrow flow of molten metal is dropped onto the disc by means of a runner, and wherein molten drops are formed from the molten metal by centrifugal force. By adding a process of spraying pressurized water, it resolves a problem where coarse particles that are too big are formed. It significantly improves the yield of fine particles that are 0.068 inch (1.73 mm) or less. However, the improvement of the yield is insufficient.

Chinese Utility Model No. 2,541,089 relates to a conventional centrifugal device for producing shots made of steel. The basic configuration of the device, wherein a disc and a unit for rotating the disc are provided at the center of a large tank for water, wherein a narrow flow of molten metal is dropped onto the disc by means of a tundish, and wherein molten drops are formed from the molten metal by centrifugal force, is the same as that in U.S. Pat. No. 2,310,590. It tries to resolve a problem in the increased rate of waste products (the rate of defects) due to the low temperature of the molten metal by the arrangement where the furnace and the tundish are integrally located near the disc. As discussed above, the conventional centrifugal methods and devices cannot sufficiently resolve the problem in the low yield of the products.

DISCLOSURE OF INVENTION

The object of the present invention is to provide a method and device for producing the shots, wherein the yield of the products is improved. The present invention resolves the following problems in the conventional centrifugal method for producing shots. A problem is the low yield, because coarse particles that are too big are formed, and because the molten drops that are ejected from the disc fly in the atmosphere to be subject to high-temperature oxidation. Thus the present invention aims to provide a method and device for producing the shots where the yield of the products can be improved.

The method for producing the shots of the present invention comprises the following steps in a space for forming molten drops. The space is covered by a cover and by a tundish. The cover is provided to cover the water in a tank and to cover the area surrounding a disc that is located above the water and rotates. The tundish penetrates through the cover. One of the steps is a step of exhausting gas to exhaust gas through an opening, which gas is generated in the space for forming the molten drops. Another of the steps is a step of forming a film of water to form a film of the water on the inner surface of the cover. Another of the steps is a step of supplying molten metal to inject molten metal into the tundish to supply the molten metal onto the rotating disc by causing the molten metal to flow through a hole in the bottom of the tundish. Another of the steps is a step of forming molten drops to form the molten drops from molten metal by centrifugal force, which molten metal is supplied onto the rotating disc. Another of the steps is a step of solidifying droplets to divide the molten drops into droplets that are smaller than the drops by causing the molten drops to collide with the film of the water on the inner surface of the cover, which film is formed in the step of forming the film of water, and then to cool and solidify the droplets.

By the present invention, since the step of exhausting the gas, the step of forming the film of water, the step of supplying the molten metal, the step of forming the molten drops, and the step of solidifying the droplets, are all performed in the space for forming the molten drops, ambient air is prevented from entering the space for forming the molten drops so as to reduce high-temperature oxidation of the molten drops. Further, since the cover is provided to cover the area surrounding the rotating disc and the film of the water is formed on the inner surface of the cover, the molten drops, which are formed by the centrifugal force of the disc, collide with the film of the water, to be divided into droplets that are smaller than the molten drops, so that the droplets are quickly cooled and solidified. Thus, since the distance travelled by the molten drops can be shortened, high-temperature oxidation can be reduced. Further, if coarse molten drops (generally a diameter of 5 mm or more) were to be formed, they would be divided into droplets that are smaller than the molten drops, so that coarse particles that cannot be used as the products are reduced. Thus because of two advantageous effects, namely, of reducing high-temperature oxidation and reducing the number of coarse particles, the yield of the products can be improved.

Meanwhile, when the space for forming the molten drops is covered by the water in the tank, the cover, and the tundish, gas that is generated in the space fills the space, to create a risk of an explosion. Thus the step of exhausting the gas is performed to exhaust the gas through the opening that is used to exhaust the gas, which is generated in the space. Since the risk of an explosion that may be caused by steam, oxygen, hydrogen, etc., each of which is generated in the space for forming the molten drops to fill the space, can be avoided, safety is ensured.

In the step of exhausting the gas a valve that is connected to the opening may be controlled to be open or closed, based on the pressure in the space for forming the molten drops. By this invention, the pressure in the space for forming the molten drops is detected so that the valve is controlled to be open or closed to keep the pressure constant. Thus the gas, which is generated in the space for forming the molten drops, is effectively exhausted and excess ambient air is prevented from entering the space. These are merits. If excess ambient air were to enter the space for forming the molten drops, the concentration of the oxygen would increase to undesirably increase high-temperature oxidation.

Further, in the step of exhausting the gas a kind and a concentration of the gas in the space may be detected, so that the valve, which is connected to the opening, is controlled to be open or closed. By this invention the kind and concentration of the gas, which is generated in the space for forming the molten drops, such as steam, oxygen, and hydrogen, are detected so that the valve is controlled to be open or closed. Thus the concentration of the gas in the space for forming the molten drops becomes stable, to preferably reduce high-temperature oxidation.

Further, in the step of exhausting the gas the aperture K of the opening may be controlled to be in the range of $K=S/V=0.005$ to 1.0, where V denotes the volume of the space for forming the molten drops ($m^3$) and S denotes the total area of the opening ($m^2$). By this invention a risk of an explosion caused by the gas, which is generated in the space, such as steam, oxygen, or hydrogen, to fill the space, is prevented. Further, the concentration of oxygen in the space is decreased, to effectively reduce high-temperature oxidation. If the aperture K were to be less than 0.005, then the risk of an explosion would increase. If the aperture K were to be more than 1.0, then ambient air would enter the space to increase the concentration of oxygen in the space, to thereby undesirably increase high-temperature oxidation. The aperture K can be adjusted by forming the opening in the cover or by utilizing the gap between the cover and the tundish. Alternatively, it can be adjusted by means of both the opening in the cover and the gap between the cover and the tundish.

The step of forming the film of water may be done under the conditions that the cover has a side that is shaped like a truncated cone and that the angle θ between the inner surface of the cover, with which the molten drops collide, and the surface of the water in the tank, is 20° to 80°. By this invention, the droplets, which are formed by dividing the molten drops, easily bounce back toward the water in the tank. Thus the droplets are preferably prevented from colliding with the molten drops. If the angle θ were to be less than 20°, the distance travelled by the molten drops to collide with the inner surface of the cover, on which the film of the water is formed, would become long, to increase high-temperature oxidation. If the angle θ were to be more than 80°, the droplets would seldom bounce back toward the water in the tank. Thus the collisions between the droplets and the molten drops undesirably increase. If the droplets were to collide with the molten drops, the deformed particles that are formed by combining two or more droplets undesirably increase, to lower the yield. Incidentally, the angle θ can be easily adjusted by preparing a plurality of covers to be replaced, which covers have different angles.

More preferably, in the step of forming the film of water the angle θ between the inner surface of the cover, with which the molten drops collide, and the surface of the water in the tank, may be in the range of 30° to 70°. By this invention the distance travelled by the molten drops to collide with the inner surface of the cover, on which the film of the water is formed, becomes short, to reduce high-temperature oxidation and to reduce the collisions between the droplets and the molten drops, to preferably improve the yield of the products.

In the step of forming the molten drops the distance L between the rim of the disc, and the inner surface of the cover with which the molten drops collide, may be adjusted to be in the range of 200 to 5,000 mm. By adjusting the distance L to be in the range of 200 to 5000 mm high-temperature oxidation of the molten drops is reduced and the distribution in particle sizes and the shapes of the droplets (the shots) can be controlled. If the distance L were to be less than 200 mm, the particle sizes of the droplets (the shots), which are formed by dividing the molten drops, would become generally small, and high-temperature oxidation would be reduced, but the deformed particles formed by combining two or more pieces of the droplets would increase. If the distance L were to be more than 5,000 mm, the particles with a good shape would be obtained with few deformed particles, but high-temperature oxidation would increase and the particle sizes of the droplets (the shots) would become generally large, so that coarse particles would be mixed. Thus these results are not desirable. Incidentally, the distance L can be easily adjusted by preparing a plurality of covers to be replaced, which covers have different sizes.

In the step of forming the film of water, cooling water is supplied to the inner surface of the cover so that the thickness of the film of the water, which film is formed by the cooling water, may be adjusted to be in the range of 0.5 to 10 mm. By adjusting the thickness of the film of the water to be in the range of 0.5 to 10 mm, no molten drops are deposited on the inner surface of the cover, and the molten drops are divided into the droplets. If the thickness of the film of the water were to be less than 0.5 mm, the molten metal would be deposited on the inner surface of the cover, so that the yield of the products would be reduced. If it were to be more than 10 mm, the molten drops would solidify before being divided into the droplets, so that coarse deformed particles would increase, to undesirably lower the yield of the products. Incidentally, the thickness of the film of the water indicates the thickness of the film of the water at the area where the molten drops collide with the film. The film of the water does not necessarily have a uniform thickness over the inner surface of the cover.

In the step of supplying the molten metal the rate to supply the molten metal to the disc may be adjusted to be in the range of 70 to 600 kg/min. By this invention the requirement for the particle size (the mean particle size) of the shots to be in the range of 0.03 to 4 mm can be satisfied in a flexible manner. If the rate to supply the molten metal were to be less than 70 kg/min, the particle size (the mean particle size) of the droplets (the shots) would be adjusted to be small, but the productivity would not be assured. If the rate were to be more than 600 kg/min, the percentage of coarse molten drops (generally a diameter of 5 mm or more) would increase, to prevent the molten drops from dividing into the droplets, so that the yield of the products would decrease.

The device for producing the shots of the present invention comprises a tank for water, a disc, a tundish, a cover, an opening, and a nozzle for water. The tank for water stores water. The disc is located above the water in the tank. The tundish is located above the disc. The cover covers the area surrounding the disc and forms a space for forming molten drops above the water in the tank and with the tundish. The opening is formed in the cover to exhaust gas that is generated in the space for forming the molten drops. The nozzle for water supplies cooling water to the inner surface of the cover to form the film of water.

By this invention, since the device for producing the shots comprises the tank for water, which stores water, the disc, which is located above the water in the tank, the tundish, which is located above the disc, and the cover, which covers the area surrounding the disc and forms the space for forming the molten drops above the water in the tank and with the tundish, ambient air is prevented from entering the space for forming the molten drops, to thereby reduce the high-temperature oxidation of the molten drops. Since the device comprises the cover, which covers the area surrounding the disc, and the nozzle for water, which supplies cooling water to the inner surface of the cover to form the film of the water, the molten drops that have been formed by the centrifugal force of the disc collide with the film of the water on the inner surface of the cover, to thereby be divided into the droplets that are smaller than the molten drops, to be quickly cooled and solidified. Thus the distance travelled by the molten drops can be shortened so as to reduce high-temperature oxidation. Further, if coarse molten drops (generally a diameter of 5 mm or more) were to be formed, they would be divided into the droplets that are smaller than the molten drops, so that coarse particles that cannot be used as the products are reduced. Thus the yield of the products can be improved because of two advantageous effects, i.e., reducing high-temperature oxidation and reducing the number of coarse particles.

Further, since the device comprises the opening, which exhausts the gas generated in the space for forming the molten drops, the gas generated in the space, such as steam, oxygen, and hydrogen, can be exhausted. Thus a risk of an explosion due to the gas filling the space is avoided, so that safety is ensured. Further, since the structure of the device is simple, manufacturing and maintaining the device is facilitated.

In the device for producing the shots of the present invention the disc may be located at the upper end of a unit for rotating the disc. By this invention replacing and maintaining the disc is preferably facilitated. Incidentally, the unit for rotating the disc may be waterproof, so that it can be located in the water in the tank, wherein the upper end of the rotary shaft of the unit for rotating the disc is located above the water in the tank.

In the device for producing the shots of the present invention the cover may be composed of plates for the cover and be axisymmetric about the axis of the rotation of the disc. By this invention, since the cover can be manufactured by using general-purpose steel plates, manufacturing and maintaining the device is preferably facilitated. Further, since the cover is axisymmetric about the axis of the rotation of the disc, the distance L between the rim of the disc and the inner surface of the cover, with which the molten drops collide, is uniform, so that the quality of the shots, such as the distribution of the particle sizes and the shapes, is improved.

In the device for producing the shots of the present invention the cover may be composed of plates for the cover and the lower end of the cover may be located in the water in the tank. By this invention, since the lower end of the cover is located in the water in the tank, neither molten drops nor the droplets travel beyond the cover, so that safety is ensured. This is a merit.

In the device for producing the shots of the present invention the cover may have a side that is shaped like a truncated cone and may have a sloping surface so that the angle θ between the inner surface of the side and the surface of the water in the tank is 20° to 80°. By this invention, the droplets, which are formed by dividing the molten drops, easily bounce back toward the water in the tank. Thus the droplets are preferably prevented from colliding with the molten drops. If the angle θ were to be less than 20°, the distance travelled by the molten drops to collide with the inner surface of the cover, on which the film of the water is formed, would become long, to increase high-temperature oxidation. If the angle θ were to be more than 80°, the droplets would bounce back toward points other than the water in the tank. Thus the collisions between the droplets and the molten drops undesirably increase. Incidentally, since the collisions between the droplets and the molten drops cause the deformed particles that are formed by combining two or more droplets to undesirably increase, the yield is lowered.

In the device for producing the shots of the present invention the angle θ between the inner surface of the side and the surface of the water in the tank may preferably be in the range of 30° to 70°. Since the angle θ is in the range of 30° to 70°, the distance travelled by the molten drops to collide with the inner surface of the cover, on which the film of the water is formed, is shortened. Thus high-temperature oxidation is reduced and the collisions between the droplets and the molten drops decrease, to improve the yield of the product.

In the device for producing the shots of the present invention a hole for causing the molten metal to flow may be formed in the bottom of the tundish. By this invention the molten metal can be stably supplied onto the rotating disc. By changing the size of the hole, the rate to supply the molten metal to the disc can be preferably adjusted.

In the device for producing the shots of the present invention the nozzle for water may be located so that a port for pouring cooling water is located on the inner surface of the cover and two or more nozzles for water may be provided above the upper end of the disc. By this invention the film of the water that covers the areas where the molten drops collide with the film of the water on the inner surface of the cover can be preferably formed In the device for producing the shots of the present invention the cover may have a central opening at the upper part of it so that the tundish penetrates through the central opening. By this invention the tundish can be easily located directly above the disc, and replacing and maintaining the tundish is preferably facilitated.

In the device for producing the shots of the present invention the aperture K of the opening may be controlled to be in the range of K=S/V=0.005 to 1.0, where V denotes the volume of the space for forming the molten drops ($m^3$) and S denotes the total area of the opening ($m^2$). By having the aperture K be in the range of 0.005 to 1.0, the risk of an explosion caused by the gas, which is generated in the space for forming the molten drops, such as steam, oxygen, or hydrogen, to fill the space, is avoided. Further, the concentration of oxygen in the space is decreased so as to effectively reduce high-temperature oxidation. If the aperture K were to be less than 0.005, then the gas in the space would not be thoroughly exhausted, so that the risk of an explosion would increase. If the aperture K were to be more than 1.0, then ambient air would enter the space, to increase the concentration of oxygen in the space, to thereby undesirably increase high-temperature oxidation. Incidentally, the aperture K can be adjusted by changing the size or number of openings that are formed in the cover. Alternatively, it can be adjusted by providing a valve on the opening to change the size of the opening. Alternatively, it can be adjusted by using a gap that is formed between the central opening and the tundish when the tundish is provided. Alternatively, it can be adjusted by means of both the opening in the cover and the gap between the cover and the tundish.

As discussed above, by the method for producing the shots of the present invention, high-temperature oxidation can be reduced. If coarse molten drops (generally a diameter of 5 mm or more) were to be formed, they could be divided into droplets that are smaller than the molten drops, to reduce coarse particles that cannot be used as the products. Thus the yield of the products can be improved because of two advantageous effects, i.e., reducing high-temperature oxidation and reducing the number of coarse particles.

Further, as discussed above, by the device for producing the shots of the present invention, high-temperature oxidation can be reduced. If coarse molten drops (generally a diameter of 5 mm or more) were to be formed, they could be divided into droplets that are smaller than the molten drops, to reduce coarse particles that cannot be used as products. Thus the yield of the products can be improved because of two advantageous effects, i.e., reducing high-temperature oxidation and reducing coarse particles. Further, the risk of an explosion can be avoided so that safety is ensured. Further, the structure of the device is simple, to facilitate manufacturing and maintaining the device.

The basic Japanese patent application, No. 2013-066298, filed Mar. 27, 2013, is hereby incorporated by reference in its entirety in the present application.

The present invention will become more fully understood from the detailed description given below. However, the detailed description and the specific embodiments are only illustrations of the desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

BEST MODE FOR CARRYING OUT THE INVENTION

Figure 1:
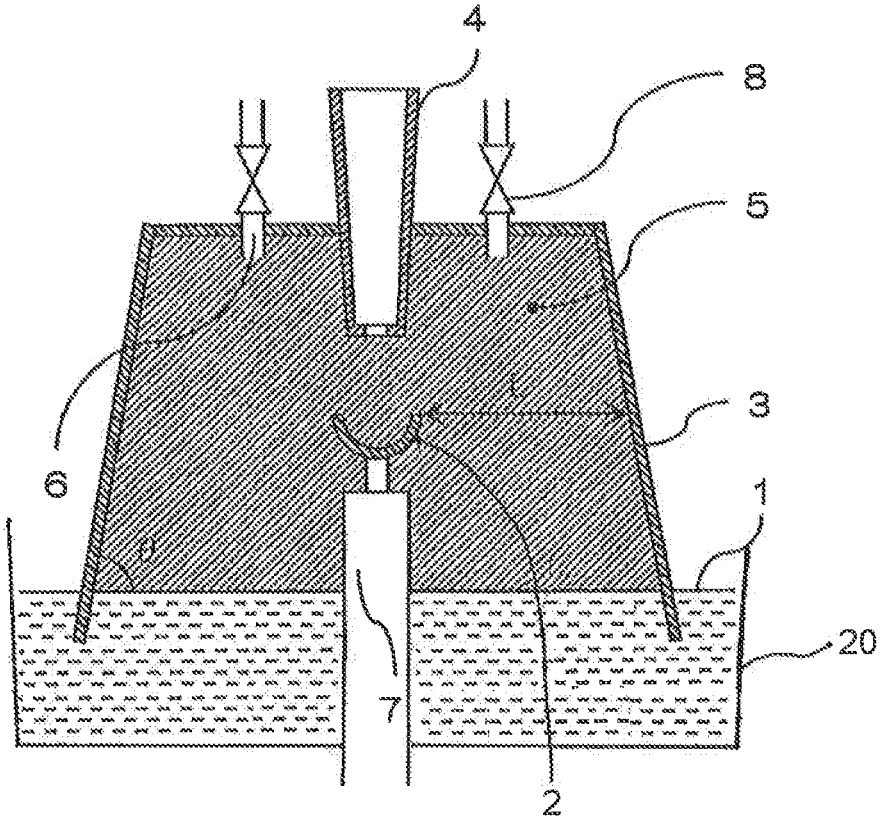
FIG. 1 is a schematic view illustrating the space for forming the molten drops and the step of exhausting the gas in the method for producing the shots of an embodiment of the present invention.
Figure 2:
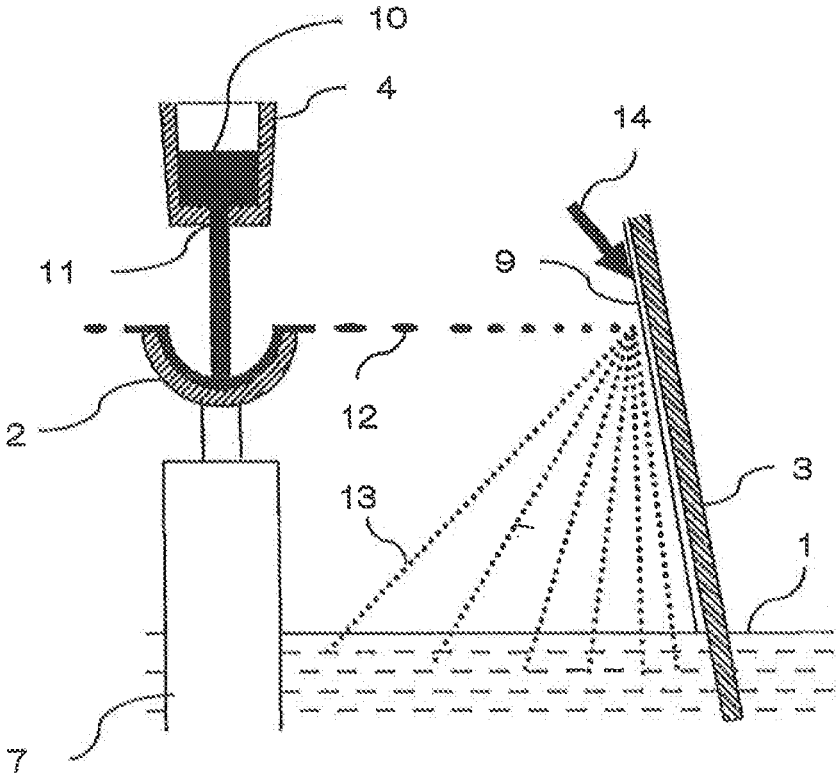
FIG. 2 is a schematic partially-enlarged view illustrating the step of forming the film of water, the step of supplying the molten metal, the step of forming the molten drops, and the step of solidifying the droplets in the method for producing the shots of an embodiment of the present invention.
Figure 3:
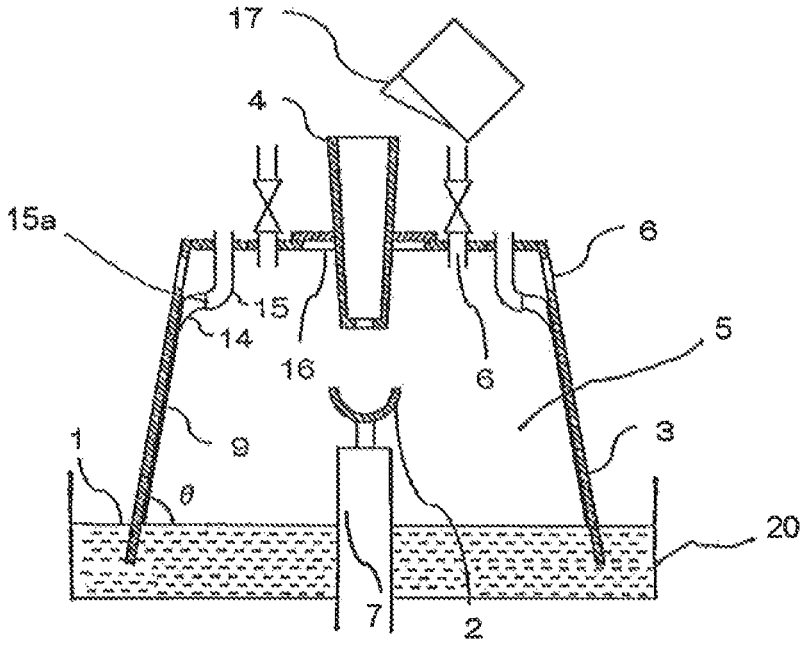
FIG. 3 is a schematic sectional view illustrating the device for producing the shots of an embodiment of the present invention.
Figure 4:
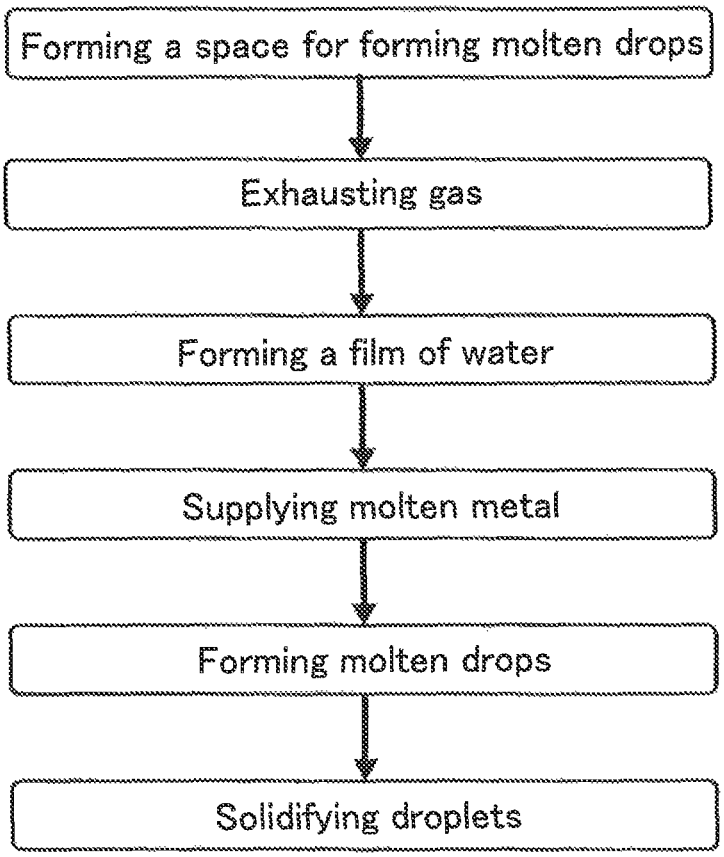
FIG. 4 is a flowchart illustrating the method for producing the shots of an embodiment of the present invention.

Below, the method and the device for producing shots of the present invention are discussed with reference to FIGS. 1 to 4. As shown in FIG. 3, the device for producing the shots of the present embodiment comprises a tank 20 for water, a disc 2, a tundish 4, a cover 3, openings 6, and a nozzle 15 for water. The tank 20 stores water. The disc 2 is located above the water in the tank 20. The tundish 4 is located above the disc 2. The cover 3 covers an area surrounding the disc 2 and forms a space 5 for forming molten drops above the water 1 in the tank 20 and with the tundish 4. The openings 6 exhaust gas that is generated in the space 5 for forming the molten drops. The nozzle 15 for water supplies cooling water to the inner surface of the cover 3. Incidentally, the pouring machine 17 in FIG. 3 is a melting furnace or a vessel (a ladle) that receives molten metal from the melting furnace. The vessel (a ladle) can be mounted on an automatic pouring machine. The automatic pouring machine may be automotive. It may also tilt, vertically move, and move the vessel (a ladle) forward and backward into pour the molten metal to the tundish.

The water 1 in the tank 20 means the water in the tank 20 that stores a cooling medium (water) to cool and solidify droplets 13 that are dropped into it. The tank 20 is open at the top. In the present invention, a conventional tank that is used in the device for producing shots by using centrifugal force may be used for the tank 20 for water. To continuously produce the shots in a large amount the tank 20 for water preferably stores a large amount of water and has a device for circulating and cooling the water so that the temperature of the water in the tank 20 does not exceed a predetermined temperature (for example, 60 to 80° C.). Further, since the droplets 13 (the shots) that have been cooled and solidified drop to the bottom of the tank 20 to be temporarily piled there, the water should be deep enough. The bottom of the tank 20 may be inclined as required to adjust the position to pile the droplets 13 (the shots).

The disc 2, which is located above the water 1 of the tank 20, is a container that is shaped like a circle or a cup to be used to form the molten drops 12 from the molten metal 10 by means of centrifugal force. It is structured by refractory materials and reinforced by steel so that it is not damaged by the rotation. In the present invention, various discs that have been used in a conventional device for producing shots by using centrifugal force can be used. The disc 2 is rotated by a unit 7 for rotating the disc. The unit 7 for rotating the disc may be waterproof, so as to be placed in the water 1 of the tank 20, but the upper end of the rotary shaft of the unit 7 is positioned above the water 1. The disc 2 is located at the upper end of the unit 7. The unit 7 supports the disc 2 by the rotary shaft to rotate the disc 2. The unit 7 typically has a configuration to rotate the shaft by a motor (not shown), but it may have any other configuration that is publicly known.

The cover 3, which covers the area surrounding the disc, covers the area surrounding the disc 2, which is located above the water 1 in the tank 20. It is essential to form the space 5 for forming the molten drops. By the cover 3, ambient air is prevented from entering the space 5 for forming the molten drops so as to reduce high-temperature oxidation of the molten drops 12. In the present embodiment the cover 3 is shaped as an upside-down cup. That is, it has a circular plate on the top and a truncated cone on the side. However, the cover 3 may take any other shape, such as a hemisphere or a semi-ellipsoid. Further, the cover 3 may be formed by plates for the cover and may be shaped to be axisymmetric about the rotary shaft of the disc 2. If the cover 3 is axisymmetric, the distance L between the rim of the disc 2 and the inner surface of the cover 3, with which surface the molten drops collide, is constant all around the disc 2 in the horizontal direction. Thus the quality, such as the distribution of particle sizes and shapes, of the shots, is improved. The lower end of the cover 3 may be positioned in the water 1 in the tank 20. If it is in the water 1 in the tank 20, no molten drops 12 nor droplets 13 fly outside the cover 3, so that safety is ensured. Further, the cover 3 may have the side shaped as a truncated cone. The side may have a sloping surface that has the angle θ (see FIG. 3) between the inner surface of the cover 3 and the surface of the water 1 in the tank 20 at a range of 20° to 80°. The angle θ between the inner surface of the cover 3 and the surface of the water 1 in the tank 20 is more preferably at a range of 30° to 70°. If the side of the cover 3 is shaped as a truncated cone as in FIGS. 1 and 3, and the angle θ is at a range of 20° to 80°, more preferably at a range of 30° to 70°, the droplets 13, which are formed by causing the molten drops 12 to collide with the inner surface of the cover 3, will likely bounce back toward the water 1 in the tank 20 so that collisions between the droplets 13 and the molten drops 12 decrease. The cover 3 has a central opening 16 at the upper part so that the tundish 4 is provided to penetrate through the central opening 16. That is, the tundish 4 is located directly above the disc 2 so that the molten metal 10 from the tundish 4 is certainly led to the disc 2. The plates for the cover can be manufactured from various types of general-purpose steel plates, such as rolled steel for a general type of structure, rolled steel for a welded structure, boiler rolled steel, and stainless steel. The cover 3 may be appropriately structured. For example, a column for supporting and securing the cover 3 may be provided to the tank 20 for water.

The tundish 4, which is located above the disc 2, stores a constant amount of the molten metal 10 that has been injected and causes the molten metal 10 to flow through a hole 11 at a constant rate so that the molten metal 10 is supplied onto the disc 2. It has the structure whereby the inner surface is formed by refractory materials and the outer surface is reinforced by steel members or the like.

The space 5 for forming the molten drops is surrounded by the water 1 in the tank 20, the cover 3, which covers the area surrounding the disc 2, and the tundish 4, which is located above the disc 2. It prevents ambient air from entering the space 5 for forming the molten drops so that high-temperature oxidation of the molten drops 12 is reduced.

The openings 6, which exhaust the gas that is generated in the space 5 for forming the molten drops, is formed for that purpose. That is, when the molten drops 12 and the droplets 13 contact the film 9 of the water that is formed on the inner surface of the cover 3 and contact the water in the tank 20, steam is generated and a part of the steam is dissolved, to thereby generate hydrogen and oxygen. Thus, if the space 5 for forming the molten drops were to be sealed, the gas would fill the space 5, to create a risk of an explosion. So, the openings 6 for exhausting the gas are provided. Further, a valve 8 may be provided to each of the openings 6 so as to regulate the gas that is exhausted through the openings 6. The valve 8 may be provided to only a part of the openings 6, not to all of them. The size of the opening of the valve 8 may be adjusted based on the detection of a sensor (a pressure gage, not shown) for measuring the pressure in the space 5 for forming the molten drops. The sensor may be located at any position. It is preferably located on the inner surface of the cover 3 and above the disc 2 so that the molten drops 12 and the droplets 13 seldom collide with the sensor (for example, the upper portion of the inner surface of the cover 3). Further, the aperture K of the openings 6 may be set to be K=S/V=0.005 to 1.0, where V denotes the volume ($m^3$) of the space 5 for forming the molten drops, and S denotes the area ($m^2$) of it. Since the aperture K is set to be 0.005 to 1.0, a risk of an explosion that is caused by gas, such as steam, oxygen, and hydrogen, filling the space 5 for forming the molten drops, can be avoided. Further, high-temperature oxidation is effectively reduced by reducing the concentration of oxygen in the space 5. If the aperture K were to be less than 0.005, gas that has generated would fill the space to create the risk of an explosion. If the aperture K were to be greater than 1.0, ambient air would enter the space to increase the concentration of oxygen, so that high-temperature oxidation would increase. They are unfavorable. The positions of, the number of, and the shapes, of the openings 6 are not limited to those as in FIG. 3. Any number of the openings 6 that have any shapes may be provided at any positions of the cover 3 where no molten drops 12 collide. Further, a gap may be formed between the central opening 16 at the upper part of the cover 3 and the tundish 4, so as to be used as the opening 6.

A sensor (not shown) for detecting the kind and concentration of the gas in the space 5 for forming the molten drops may be provided. For example, an oxygen sensor or a hydrogen sensor may be used.

The nozzle 15 for water, which supplies cooling water to the inner surface of the cover 3, forms the film 9 of the water that covers the area of the inner surface of the cover 3 where the molten drops collide with it. In the nozzle 15 for water a plurality of the ports **15*a* for pouring the cooling water 14 may be located at the inner surface of the cover 3 and above the upper end of the disc 2. The wording "the port 15*a* is located at the inner surface of the cover 3" means that, as in FIG. 3 for example, the port 15*a* is located inside the inner surface of the cover 3 and near the inner surface so that the cooling water 14 that has been discharged from the port 15*a* flows along the inner surface of the cover 3. For example, the distance between the port 15*a* and the inner surface of the cover 3 is 2 cm or less, or 1 cm or less. Incidentally, the shape of the nozzle 15 for water is not limited to that in FIG. 3. It may penetrate through the side of the cover 3**, not through the top, may have no bend, and may have the port

15*a* directed toward the center of the space 5 for forming the molten drops. In this case, by slowing the rate of the discharged cooling water 14, the cooling water flows down the inner surface of the cover 3. The nozzle 15 for water may be any of various shapes of commercially available nozzles. A nozzle having two or more ports 15*a* may be used. A circular steel pipe on which a plurality of ports 15*a* are provided is called "a nozzle for water" in the present invention.

Below, the operation of the device for producing the shots, i.e., the method for producing the shots of the present embodiment, is discussed. As in the flowchart in FIG. 4, the method for producing the shots of the present embodiment includes the following steps that are performed in the space 5 for forming the molten drops. The space 5 is surrounded by the water 1 in the tank 20, the cover 3 that covers the area surrounding the rotating disc 2, which is located above the water 1, and the tundish 4 that penetrates through the cover 3. The steps include:

the step of exhausting the gas, to exhaust gas through the openings 6, which is provided to exhaust gas that is generated in the space 5 for forming the molten drops, the step of forming the film of water, to form the film 9 of the water on the inner surface of the cover 3, the step of supplying the molten metal, to inject the molten metal 10 into the tundish 4 and cause the molten metal 10 to flow through the hole 11 in the bottom of the tundish 4 so as to supply the molten metal 10 on the rotating disc 2, the step of forming the molten drops, to form the molten drops 12 by centrifugal force from the molten metal 10 that has been supplied to the rotating disc 2, and the step of solidifying the droplets, to cause the molten drops 12 to collide with the film 9 of the water on the inner surface of the cover 3, which film has been formed in the step of forming the film of water to divide the molten drops 12 into the droplets 13 that are smaller than the molten drops 12, and then to cool and solidify the droplets 13.

Below, each of the steps is discussed. First, the step of exhausting the gas is discussed. In an embodiment of the present invention, the following phenomena occur in the space 5 for forming the molten drops. The molten drops 12 and the droplets 13 contact the film 9 of the water on the inner surface of the cover 3 and the water in the tank 20 so that steam is generated. A part of the steam is dissolved so that hydrogen and oxygen are generated. Thus, if the space 5 for forming the molten drops were to be sealed, gas as discussed above would fill in the space 5 to create a risk of an explosion. So the step of exhausting the gas is provided to exhaust the gas through the openings 6. In the step of exhausting the gas the valve 8 that is provided to the openings 6 may be controlled to be open or closed based on the pressure in the space 5. That is, the valve 8 is provided to the openings 6 and a sensor for detecting the pressure in the space 5 is provided so as to control the pressure to be within a predetermined range. If the pressure exceeds an upper limit, the valve 8 is opened to discharge the gas so as to prevent an explosion. If the pressure falls below a lower limit, the valve 8 is closed to prevent ambient air from entering the space 5 so as to reduce high-temperature oxidation. Further, in the step of exhausting the gas, by detecting the kind and concentration of the gas the valve 8 that is provided to the openings 6 may be controlled to be open or closed. That is, a sensor for detecting the kind and concentration of the gas is provided and the valve 8 that is provided to the openings 6 may be controlled to be open or closed so that the concentration of the gas in the space 5 for forming the molten drops can be stabilized. Further, in the step of exhausting the gas, the aperture K of the openings 6 may be controlled to be in the range of K=S/V=0.005 to 1.0, where V denotes the volume of the space for forming the molten drops (m) and S denotes the total area of the opening ($m^2$).

Next, the step of forming the film of water is discussed. In the embodiment of the present invention, as in FIG. 2 the molten drops 12 collide with the cover 3 to be divided into the droplets 13, which are smaller than the molten drops 12. At this time, the temperature of the inner surface of the cover 3, with which the molten drops 12 collide, should be prevented from increasing. The molten drops 12 should be prevented from being deposited on the inner surface of the cover 3. So, the step of forming the film of water is provided so that the cooling water 14 is supplied to the inner surface of the cover 3 to form the film 9 of the water. Because of the film 9 of the water, which is formed in the step of forming the film of water, no molten drops 12 are deposited on the inner surface of the cover 3. Further, the molten drops 12 are effectively divided into the droplets 13. The thickness of the film 9 of the water can be adjusted by changing the flow rate of the cooling water to be supplied. In the step of forming the film of water the angle θ between the inner surface of the cover 3, with which the molten drops 12 collide, and the surface of the water 1 in the tank 20, can be set in a range of 20° to 80°. More preferably it may be set in a range of 30° to 70°. In the step of forming the film of water, the thickness of the film 9 of the water, which is formed by supplying the cooling water to the inner surface of the cover, can be adjusted to be 0.5 to 10 mm. Incidentally, the angle θ is an angle that is made by the area of the inner surface of the cover 3 where the molten drops 12 collide and the surface of the water 1 in the tank 20. It is not necessarily an angle at a part where the inner surface of the cover 3 contacts the surface of the water 1. If the angle θ were to be less than 20°, the distance that the molten drops 12 would travel from the disc 2 to the inner surface of the cover 3, on which the film 9 of the water is formed, would become long. Especially, it would become long when the molten drops 12 would fly near the water 1. Thus high-temperature oxidation would increase. If the angle θ were to be greater than 80°, the droplets 13 that bounce back after colliding with the inner surface of the cover 3, on which the film 9 of the water is formed, would likely fly in a direction that is near the horizon, not toward the water 1. Thus they would collide with the molten drops 12 so that the deformed particles would increase and the yield would decrease. Thus the angle θ is set to be in a range of 20° to 80°, more preferably in a range of 30° to 70°, so that the distance that the molten drops 12 fly does not become long, so that high-temperature oxidation is prevented, and so that the collisions between the droplets 13 and the molten drops 12 are prevented. Thus a high yield can be maintained. The thickness of the film 9 of the water is the thickness of the film 9 of the water at an area where the molten drops 12 collide with it. If it were to be less than 0.5 mm, the molten drops 12 would be deposited on the inner surface of the cover 3 so that the yield would be decreased. If it were to be greater than 10 mm, the molten drops 12 would solidify before being divided into the droplets 13. Thus coarse deformed particles would be generated so that the yield would be decreased. By setting the thickness of the film 9 of the water to be in a range of 0.5 to 10 mm a high yield can be maintained.

The step of supplying the molten metal is now discussed. In the embodiment of the present invention, the step of supplying the molten metal is provided to inject the molten metal 10 that has been melted to have predetermined chemical compositions in a melting furnace to the tundish 4 so that the molten metal 10 is supplied through the hole 11 that is formed in the bottom of the tundish 4 onto the rotating disc 2. The tundish 4 stores a constant amount of the molten metal 10 that has been injected and causes the molten metal 10 to flow at a constant rate through the hole 11 to supply it onto the disc 2. Since the tundish 4 is provided to penetrate through the cover 3, the molten metal 10 can be supplied onto the rotating disc 2 from the outside of the space 5 for forming the molten drops. The rate for supplying the molten metal 10 onto the disc 2 can be adjusted to be 70 to 600 kg/min. The rate can be adjusted by changing the size of the hole 11 or the number of holes 11 or by changing the depth of the molten metal in the tundish 4. If the rate were to be less than 70 kg/min, the particle size (the mean particle size) of the droplets (the shots) would be adjusted to be small, but the productivity would not be assured. If the rate were to be greater than 600 kg/min, the possibility to form coarse molten drops (generally a diameter of 5 mm or more) would increase so that the molten drops would not be divided into the droplets with a desired size (for example, 0.003 mm to 4 mm). Thus the yield would be decreased. By adjusting the rate to be in a range of 70 to 600 kg/min, adequate droplets (the shots) with the desired particle size can be produced.

The step of forming the molten drops is now discussed. In the embodiment of the present invention, the step of forming the molten drops is provided to form the molten drops 12 by centrifugal force from the molten metal 10 that has been supplied to the rotating disc 2. The disc 2 is a container that is shaped like a circle or a cup. It is structured by refractory materials and reinforced by steel so that it is not damaged by the rotation. The disc 2 is driven by the unit 7 for rotating the disc and is rotated. In the step of forming the molten drops the molten metal 10 that has been supplied near the center of the rotating disc 2 spreads toward the rim of the disc 2 by centrifugal force. The molten drops 12 are formed when the molten metal 10 is ejected from the rim or while it flies. In the step of forming the molten drops the distance L between the rim of the disc 2 and the inner surface of the cover 3, with which the molten drops 12 collide, may be adjusted to be in the range of 200 mm to 5,000 mm. If the distance L were to be less than 200 mm, the molten drops 12 would likely collide with the droplets 13 that fly after the molten drops 12 would collide with the inner surface of the cover 3, to be divided. Thus the deformed particles that would be formed by combining two or more droplets 13 would increase so that the distribution in the particle sizes of the droplets (the shots) would generally be shifted to the side of large particles and coarse particles would be included. This is unfavorable. If the distance L were to be more than 5,000 mm, high-temperature oxidation would likely increase. This is unfavorable. By adjusting the distance L to be in the range of 200 mm to 5,000 mm, high-temperature oxidation of the molten drops can be reduced and the distribution in the particle sizes and the shapes of the droplets (the shots) can be controlled. Incidentally, the distance L can be easily adjusted by preparing a plurality of covers, the sizes of which differ, and by replacing the cover with one of them.

The step of solidifying the droplets is now discussed. In the embodiment of the present invention the step of solidifying the droplets is provided to cause the molten drops 12 to collide with the film 9 of the water on the inner surface of the cover 3, which film has been formed in the step of forming the film of water. Thus the molten drops 12 are divided into the droplets 13 that are smaller than the molten drops 12 and then the droplets 13 are cooled and solidified. In that step, it is estimated that the molten drops 12 are divided into the droplets 13, since they suffer from mechanical impacts caused by the collision with the film 9 of the water on the inner surface of the cover 3 and from local impacts caused by vapor explosions. As in FIG. 2, the droplets 13 drop in the water in the tank 20 to be cooled and solidified to become the shots.

Now, the shots are discussed. The shots in the embodiment of the present invention are shots made of a ferrous alloy, which include shots made of cast steel, such as shots of high-carbon cast steel specified in Japanese Industrial Standards Z0311 (2004) and shots of low-carbon cast steel, and shots made of stainless steel, such as shots made of stainless cast steel. Various particle sizes (the mean particle sizes) of the shots are specified within a range of about 0.03 to 4 mm in Japanese Industrial Standards Z0311 (2004).

As discussed above, by the method and device for producing the shots of the present embodiment high-temperature oxidation can be reduced. Further, if coarse molten drops (generally a diameter of 5 mm or more) were formed, coarse particles that could not be used for the products would seldom be produced, since the molten drops would be divided into the droplets that are smaller than the molten drops. Thus the yield is improved by two advantageous effects, i.e., the reduction of high-temperature oxidation and the reduction of the production of coarse particles.

As discussed above, by the device for producing the shots of the present embodiment, since the risk of an explosion can be avoided, safety is ensured. In addition, the structure of the device is simple so that manufacturing and maintaining the device is facilitated.

The method for producing the shots of the present embodiment comprises the step of exhausting the gas, the step of forming the film of water, the step of supplying the molten metal, the step of forming the molten drops, and the step of solidifying the droplets. These steps are discussed in the order listed above. However, as another embodiment, some of these steps may be simultaneously performed, or some steps may be performed in the reverse order. For example, the step of exhausting the gas and the step of forming the film of water may be performed in the reverse order or at the same time.

TESTING EXAMPLE 1

Below, Testing Example 1 of the present invention is discussed. In this example, the shots of high-carbon cast steel were produced so that the effects of the present invention were examined. Scrap steel, Fe—Si, Fe—Mn, carburizer, and so on, were blended to a predetermined concentration. Then 5,000 kg of them were melted by using a high-frequency induction furnace that can treat 5,000 kg in steel equivalent. Then all the molten metal was used by being tapped. The temperature of the molten metal was 1,640° C. to 1,680° C. The molten metal was subject to deoxidation by using pure aluminum just before being tapped. The molten metal was received by the ladle 10 times, i.e., 500 kg each. It was poured on the tundish 4 of the device for producing the shots as in FIG. 3 to produce the shots. All of the shots were retrieved from the tank 20 for water and were dried by hot air in a fluid-bed dryer so that their weight was measured. The rate of the loss due to high-temperature oxidation can be calculated by the following equation:

The rate of the loss due to high-temperature oxidation (weight %)=(1−weight of retrieved shots/weight of molten metal)×100

The dried shots were sieved so that the distribution of the particle sizes was measured. After being quickly cooled by the water in the tank 20, most of the oxide that had been formed by high-temperature oxidation was scraped from the shots, to be broken into fine powders. Thus the powders were sucked into a dust collector during drying to be separated from the shots By this Testing Example, the rate for supplying the molten metal to the disc 2 was 170 kg/min, the speed of the rotation at the rim of the disc 2 was 10.5 m/s, the angle θ between the inner surface of the cover 3 and the surface of the water 1 in the tank 20 was 50°, the thickness of the film 9 of the water was 2 mm, and the aperture K of the openings 6 was 0.3. The distances L between the rim of the disc 2 and the inner surface of the cover 3 were 1,200 mm for Working Example 1 and 2,500 mm for Working Example 2. In Comparative Example 1, which is a conventional device for producing shots by using centrifugal force, the disc and the unit for rotating the disc were installed at the center of the tank for water, without a cover. A thin flow of the molten metal was poured onto the disc so that the molten drops were formed from the molten metal by the centrifugal force. The results of Working Examples 1 and 2 were compared with the results of Comparative Example 1.

The distributions of the particle sizes that were measured are shown in Table 1. In Comparative Example 1, which is a conventional device using centrifugal force, the particles that have a size of 3.350 mm or over were 8.5%, but they are 0.8% in Working Example 1 and 2.9% in Working Example 2. Thus the number of coarse particles was reduced. In observing the shots of 3.350 mm or over in Comparative Example 1, it was seen that about half of them had a size of over 4 mm, so that they had to be again melted. In contrast, seldom did shots in Working Example 1 and Working Example 2 have a size of over 4 mm. Thus, since they did not have to be again melted, it was confirmed that the yield was improved. Further, the distributions of the particle sizes in Working Example 1 and Working Example 2 shifted to the side of fine particles compared to those in Comparative Example 1. Thus it was confirmed that the molten drops that had been formed by the centrifugal force of the disc collided with the film of the water on the inner surface of the cover to be divided into the droplets that are smaller than the molten drops. About an effect caused by the distance L between the rim of the disc 2 and the inner surface of the cover 3, the distribution of particle sizes in Working Example 1, where the distance L is shorter than that in Working Example 2, slightly shifted to the side of fine particles. In neither Working Example 1 nor Working Example 2 were any molten drops deposited on the cover nor were any deformed particles formed. No explosion caused by the gas that had been generated in the space for forming the molten drops occurred. Incidentally, the term "PAN" in Table 1 denotes fine powders that have passed through the mesh of the minimum size.

TABLE 1

| Sieve Openings (mm) | Distribution of particle sizes (weight %) | | |
|---|---|---|---|
| | Working Example 1 (with cover) (L = 1,200 mm) | Working Example 2 (with cover) (L = 2,500 mm) | Comparative Example 1 (without cover) |
| 3.350 or over | 0.8 | 2.9 | 8.4 |
| 2.800 | 0.8 | 4.9 | 10.6 |
| 2.360 | 1.2 | 6.8 | 15.0 |
| 2.000 | 1.8 | 7.8 | 13.6 |

TABLE 1-continued

| Sieve Openings (mm) | Distribution of particle sizes (weight %) | | |
|---|---|---|---|
| | Working Example 1 (with cover) (L = 1,200 mm) | Working Example 2 (with cover) (L = 2,500 mm) | Comparative Example 1 (without cover) |
| 1.700 | 3.5 | 9.0 | 13.2 |
| 1.400 | 6.4 | 11.1 | 11.9 |
| 1.180 | 8.4 | 11.5 | 8.7 |
| 1.000 | 11.0 | 10.3 | 5.7 |
| 0.850 | 10.9 | 9.4 | 3.8 |
| 0.710 | 13.0 | 8.2 | 2.7 |
| 0.600 | 12.0 | 6.3 | 1.8 |
| 0.500 | 9.0 | 4.0 | 1.3 |
| 0.425 | 8.2 | 3.0 | 1.0 |
| 0.355 | 6.1 | 1.9 | 0.8 |
| 0.300 | 2.8 | 0.9 | 0.3 |
| 0.250 | 2.2 | 0.7 | 0.3 |
| 0.212 | 1.0 | 0.4 | 0.2 |
| 0.180 | 0.4 | 0.2 | 0.2 |
| 0.150 | 0.2 | 0.2 | 0.2 |
| 0.125 | 0.1 | 0.1 | 0.1 |
| 0.106 | 0.0 | 0.1 | 0.1 |
| PAN | 0.2 | 0.3 | 0.1 |
| Total | 100.0 | 100.0 | 100.0 |

TESTING EXAMPLE 2

In this Testing Example, the effects on high-temperature oxidation of the shots were examined. In Testing Example 1 the shots were produced in the conditions (the rate for supplying the molten metal and the speed of the rotation at the rim of the disc) that are common to both the Working Example and the Comparative Example, the distributions of particle sizes in Working Example 1 and Working Example 2 shifted to the side of fine particles compared with the distributions in Comparative Example 1. The rate of the loss (weight %) due to high-temperature oxidation is affected by the particle sizes of the shots. Generally, the smaller the particles are, the more high-temperature oxidation occurs. So, the shots in Comparative Example 2 were produced so as to have the distributions of particle sizes that are substantially the same as those in Working Example 1. In Comparative Example 2 the rate for supplying the molten metal to the disc 2 was 170 kg/min and the speed of the rotation at the rim of the disc 2 was 15 m/s.

The results of the measurements of the distributions of particle sizes are shown in Table 2. The calculated rates of the loss (weight %) due to high-temperature oxidation are listed in Table 3. In Comparative Example 2, which is a conventional method for producing shots by using centrifugal force, no molten drops that had been formed by means of centrifugal force of the disc collided with the film of the water on the inner surface of the cover to be divided into droplets that were smaller than the molten drops. Thus the distributions of particle sizes were wide and coarse particles were included. When the distributions of particle sizes in Comparative Example 2 were compared with those in Comparative Example 1, it was seen that the percentage of particle sizes of less than 1 mm remarkably increased, to 49.3% (12.9% in Comparative Example 1). Incidentally, that in Working Example 1 was 66.1%. When the rates of the loss (weight %) due to high-temperature oxidation in Working Example 1 were compared with that in Comparative Example 2, it was seen that the rate in Working Example 1 was 1.8% and that in Comparative Example 2 was 14.6%, as in Table 3. Though the percentage of particle sizes of less than 1 mm in Comparative Example 2 was less than that in Working Example 1, the rate of loss was larger. The reason is that the molten drops that had been ejected from the disc were subject to a high degree of high-temperature oxidation in the ambient air.

TABLE 2

| Sieve Openings (mm) | Distribution of particle sizes (weight %) Working Example 1 (with cover) (L = 1,200 mm) | Comparative Example 2 (without cover) |
|---|---|---|
| 3.350 or over | 0.8 | 3.7 |
| 2.800 | 0.8 | 4.1 |
| 2.360 | 1.2 | 4.3 |
| 2.000 | 1.8 | 5.9 |
| 1.700 | 3.5 | 6.6 |
| 1.400 | 6.4 | 9.0 |
| 1.180 | 8.4 | 8.3 |
| 1.000 | 11.0 | 8.8 |
| 0.850 | 10.9 | 8.7 |
| 0.710 | 13.0 | 8.8 |
| 0.600 | 12.0 | 7.6 |
| 0.500 | 9.0 | 6.8 |
| 0.425 | 8.2 | 5.4 |
| 0.355 | 6.1 | 4.4 |
| 0.300 | 2.8 | 3.1 |
| 0.250 | 2.2 | 2.3 |
| 0.212 | 1.0 | 1.2 |
| 0.180 | 0.4 | 0.4 |
| 0.150 | 0.2 | 0.3 |
| 0.125 | 0.1 | 0.1 |
| 0.106 | 0.0 | 0.1 |
| PAN | 0.2 | 0.1 |
| Total | 100.0 | 100.0 |

TABLE 3

| | Working Example 1 (with cover) (L = 1,200 mm) | Comparative Example 2 (without cover) |
|---|---|---|
| Rates of the loss (weight %) due to high-temperature oxidation | 1.8 | 14.6 |

As discussed above, by the method for producing the shots of Testing Example 1 and Testing Example 2 high-temperature oxidation can be reduced. Further, if coarse molten drops (generally a diameter of 5 mm or more) are formed, they are divided into droplets that are smaller than the molten drops, so that coarse particles that cannot be used as the products are seldom produced. Thus because of two effects, i.e., the reduction of high-temperature oxidation and the reduction of the production of coarse particles, the yield is improved.

TESTING EXAMPLE 3

In the present testing example, the effects caused by the aperture K were examined. In the present testing example, the shots of high-carbon cast steel were produced by the method that is the same as that of Testing Example 1. The rate for supplying the molten metal to the disc 2 was 220 kg/min, the speed of the rotation at the rim of the disc 2 was 11 m/s, the angle θ between the inner surface of the cover 3 and the surface of the water 1 in the tank 20 was 40°, the thickness of the film 9 of the water was 1.5 mm, and the distances L between the rim of the disc 2 and the inner surface of the cover 3 was 2,000 mm. The apertures K, which are in a range of 0.005 to 1.0, were 0.01 for Working Example 3 and 0.9 for Working Example 4. They were 0.003 for Comparative Example 3 and 1.5 for Comparative Example 4, and thus outside of the range. Whether an explosion occurred due to gas that has been generated is determined and the rates of the loss due to high-temperature oxidation were measured.

The results of the tests are listed in Table 4. In Working Example 3 and Working Example 4 no explosion occurred and the rates of the loss (weight %) due to high-temperature oxidation were 4% or less. In contrast, a small explosion occurred in Comparative Example 3. In Comparative Example 4 no explosion occurred, but the rate of the loss (weight %) due to high-temperature oxidation exceeded 10%. Thus it was estimated that in Comparative Example 3, since the aperture K was too small, sufficient hydrogen gas that had been generated in the space for forming the molten drops was not discharged. Thus the explosion occurred. It was also estimated that in Comparative Example 4, since the aperture K was too large, the amount of ambient air that entered the space increased. Thus the rate of the loss (weight %) due to high-temperature oxidation increased. Incidentally, the concentration of oxygen in the space for forming the molten drops at 2 minutes after the step of supplying the molten metal started was 1.8 vol. % in Working Example 3, but it was 14.2 vol. % in Comparative Example 4. So the concentration of oxygen was definitely increased.

TABLE 4

| | Working Example 3 | Working Example 4 | Comparative Example 3 | Comparative Example 4 |
|---|---|---|---|---|
| Aperture K | 0.01 | 0.9 | 0.003 | 1.5 |
| Explosion | none | none | occurred | none |
| Rates of the loss (weight %) due to high-temperature oxidation | 2.2 | 3.8 | 2.1 | 10.2 |

As discussed above, by the device for producing the shots of Testing Example 3 high-temperature oxidation can be reduced. As is obvious in Testing Examples 1 and 2, if coarse molten drops (generally a diameter of 5 mm or more) are formed, they are divided into the droplets that are smaller than the molten drops so that coarse particles that cannot be used as the products are seldom produced. Thus because of two effects, i.e., the reduction of high-temperature oxidation and the reduction of the production of coarse particles, the yield is improved. Further, since the risk of an explosion can be avoided, safety is ensured. In addition, the structure of the device is simple so that manufacturing and maintaining the device is facilitated.

Below, the main reference numerals and symbols that are used in the detailed description and drawings are listed.

1. water in a tank
2. a disc
3. a cover
4. a tundish
5. a space for forming molten drops
6. an opening
7. a unit for rotating the disc
8. a valve
9. a film of water
10. molten metal
11. a hole
12. molten drops
13. droplets
14. cooling water

15. a nozzle for water
16. a central opening
17. a pouring machine
20. a tank for water

The invention claimed is:

1. A method for producing shots in a space for forming molten drops, wherein the space is covered by a cover and by a tundish, the cover being provided to cover water in a tank and to cover an area surrounding a disc that is located above the water and rotates, and the tundish penetrating through the cover, the method comprising the steps of:

exhausting gas through an opening, which gas is generated in the space for forming the molten drops;

forming a film of water on an inner surface of the cover;

supplying molten metal to inject molten metal into the tundish to supply the molten metal onto the rotating disc by causing the molten metal to flow through a hole in a bottom of the tundish;

forming molten drops from the molten metal by centrifugal force, which molten metal is supplied onto the rotating disc;

dividing the molten drops into droplets that are smaller than the molten drops by causing the molten drops to collide with the inner surface of the cover, on which the film of the water is formed in the step of forming the film of water, and then to cool and solidify the droplets, wherein in the step of exhausting gas a valve that is connected to the opening is controlled to be open if pressure in the space for forming the moltent drops exceeds an upper limit or closed if the pressure in the space for forming the molten drops falls below a lower limit.

2. The method for producing the shots of claim 1, wherein in the step of exhausting the gas an aperture K of the opening is controlled to be in a range of K=S/V=0.005 to 1.0, where V denotes a volume of the space for forming the molten drops ($m^3$) and S denotes a total area of the opening ($m^2$).

3. The method for producing the shots of claim 1, wherein the step of forming the film of water is done under conditions that the cover has a side that is shaped like a truncated cone and that an angle θ between the inner surface of the cover, with which the molten drops collide, and a surface of the water in the tank, is 20° to 80°.

4. The method for producing the shots of claim 3, wherein in the step of forming the film of water the angle θ between the inner surface of the cover, with which the molten drops collide, and the surface of the water in the tank, is in a range of 30° to 70°.

5. The method for producing the shots of claim 1, wherein in the step of forming the molten drops a distance L between a rim of the disc, and the inner surface of the cover with which the molten drops collide, is adjusted to be in a range of 200 to 5,000 mm.

6. The method for producing the shots of claim 1, wherein in the step of forming the film of water, cooling water is supplied to the inner surface of the cover so that a thickness of the film of the water, which film is formed by the cooling water, is adjusted to be in a range of 0.5 to 10 mm.

7. The method for producing the shots of claim 1, wherein in the step of supplying the molten metal a rate to supply the molten metal to the disc is adjusted to be in a range of 70 to 600 kg/min.

8. A method for producing shots in a space for forming molten drops, wherein the space is covered by a cover and by a tundish, the cover being provided to cover water in a tank and to cover an area surrounding a disc that is located above the water and rotates, and the tundish penetrating through the cover, the method comprising the steps of:

exhausting gas through an opening, which gas is generated in the space for forming the molten drops;

forming a film of water on an inner surface of the cover;

supplying molten metal to inject molten metal into the tundish to supply the molten metal onto the rotating disc by causing the molten metal to flow through a hole in a bottom of the tundish;

forming molten drops from the molten metal by centrifugal force, which molten metal is supplied onto the rotating disc;

dividing the molten drops into droplets that are smaller than the molten drops by causing the molten drops to collide with the inner surface of the cover, on which the film of the water is formed in the step of forming the film of water, and then to cool and solidify the droplets, wherein in the step of exhausting the gas a kind and a concentration of the gas in the space for forming the molten drops are detected, so that a valve, which is connected to the opening, is controlled to be open or closed to stabilize the concentration of the gas in the space for forming the molten drops.

9. The method for producing the shots of claim 8, wherein in the step of exhausting the gas an aperture K of the opening is controlled to be in a range of K=S/V=0.005 to 1.0, where V denotes a volume of the space for forming the molten drops ($m^3$) and S denotes a total area of the opening ($m^2$).

10. The method for producing the shots of claim 8, wherein the step of forming the film of water is done under conditions that the cover has a side that is shaped like a truncated cone and that an angle θ between the inner surface of the cover, with which the molten drops collide, and a surface of the water in the tank, is 20° to 80°.

11. The method for producing the shots of claim 10, wherein in the step of forming the film of water the angle θ between the inner surface of the cover, with which the molten drops collide, and the surface of the water in the tank, is in a range of 30° to 70°.

12. The method for producing the shots of claim 8, wherein in the step of forming the molten drops a distance L between a rim of the disc, and the inner surface of the cover with which the molten drops collide, is adjusted to be in a range of 200 to 5,000 mm.

13. The method for producing the shots of claim 8, wherein in the step of forming the film of water, cooling water is supplied to the inner surface of the cover so that a thickness of the film of the water, which film is formed by the cooling water, is adjusted to be in a range of 0.5 to 10 mm.

14. The method for producing the shots of claim 8, wherein in the step of supplying the molten metal a rate to supply the molten metal to the disc is adjusted to be in a range of 70 to 600 kg/min.

* * * * *